US007097214B2

(12) United States Patent
Tsai

(10) Patent No.: US 7,097,214 B2
(45) Date of Patent: Aug. 29, 2006

(54) LATCH DEVICE FOR SLIDING WINDOWS

(75) Inventor: Miao Hsueh Tsai, Taichung (TW)

(73) Assignee: Imperial USA, Ltd., Charlotte, NC (US)

( * ) Notice: Subject to any disclaimer, the term of this patent is extended or adjusted under 35 U.S.C. 154(b) by 0 days.

(21) Appl. No.: 11/231,524

(22) Filed: Sep. 21, 2005

(65) Prior Publication Data

US 2006/0097521 A1 May 11, 2006

Related U.S. Application Data

(63) Continuation of application No. 10/463,971, filed on Jun. 17, 2003, now abandoned.

(51) Int. Cl.
*E05C 1/12* (2006.01)

(52) U.S. Cl. ..... 292/157; 292/156

(58) Field of Classification Search ..... 292/175, 292/156, 157, 158, 159, DIG. 20, DIG. 46
See application file for complete search history.

(56) References Cited

U.S. PATENT DOCUMENTS 491,285 A 2/1893 Hermann
1,349,046 A 8/1920 Chaffee
1,654,221 A 12/1927 Kline
1,713,026 A 5/1929 Chaffee
2,033,085 A 3/1936 Schunk
2,253,495 A * 8/1941 Cordrey et al. ..... 70/447
3,216,756 A 11/1965 Ahlgren
5,044,181 A * 9/1991 Roop et al. ..... 70/131

* cited by examiner

*Primary Examiner*—Gary Estremsky
(74) *Attorney, Agent, or Firm*—Alston & Bird LLP

(57) ABSTRACT

A latch device for sliding windows includes a casing fixed to a sliding window and having a latch member movably received in the casing. The latch member is biased by a spring and includes two latches. A driving assembly includes a driving member from which an eccentric protrusion extends which is movably engaged with a plate of the latch member. The latch member retractably retracted through a front wall of the casing by operating the driving assembly when opening the window. The latch member includes an inclined surface which allows the latch member to be automatically retracted when closing the window without operating the handle.

16 Claims, 5 Drawing Sheets

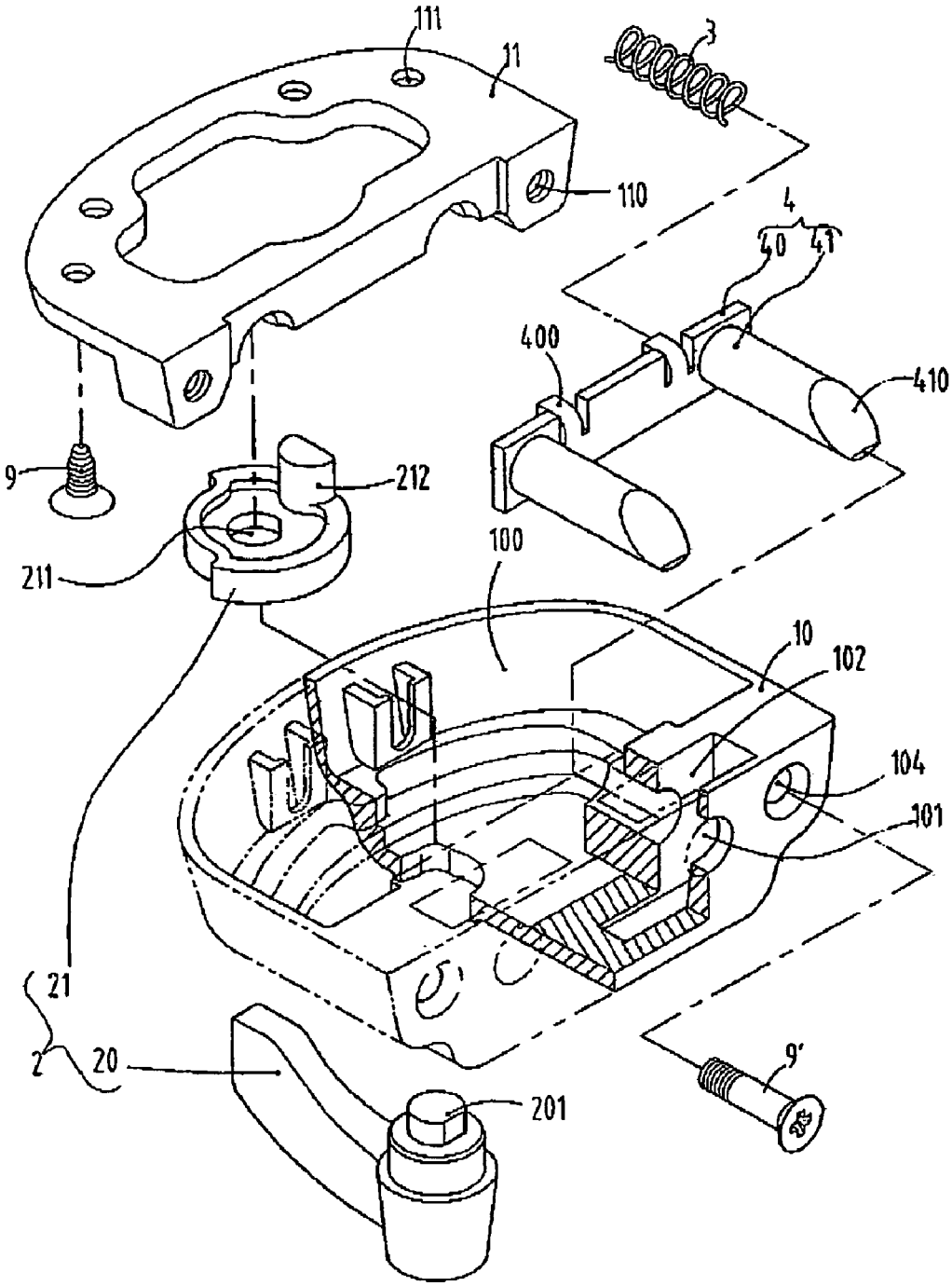
FIG. ONE

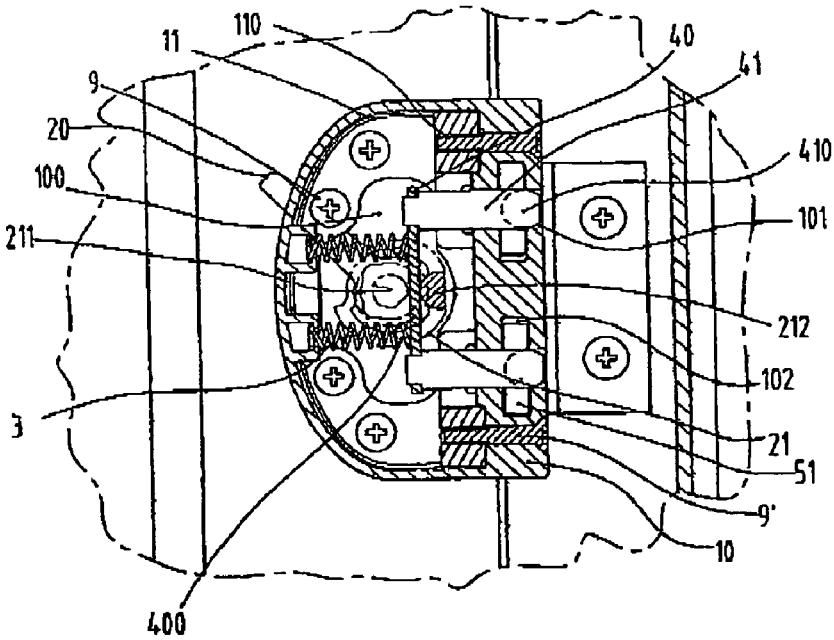
FIG. SIX
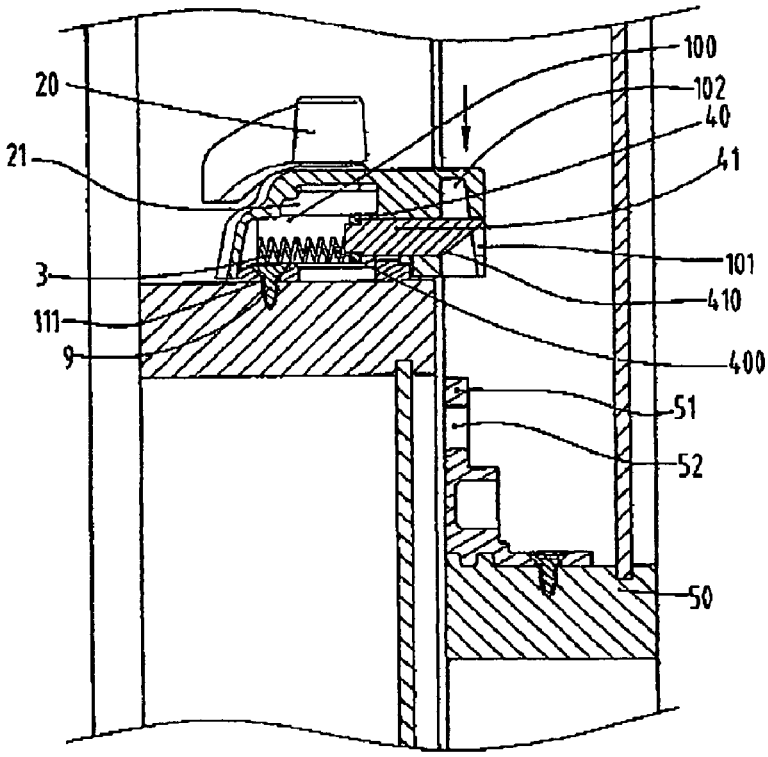
FIG. TWO

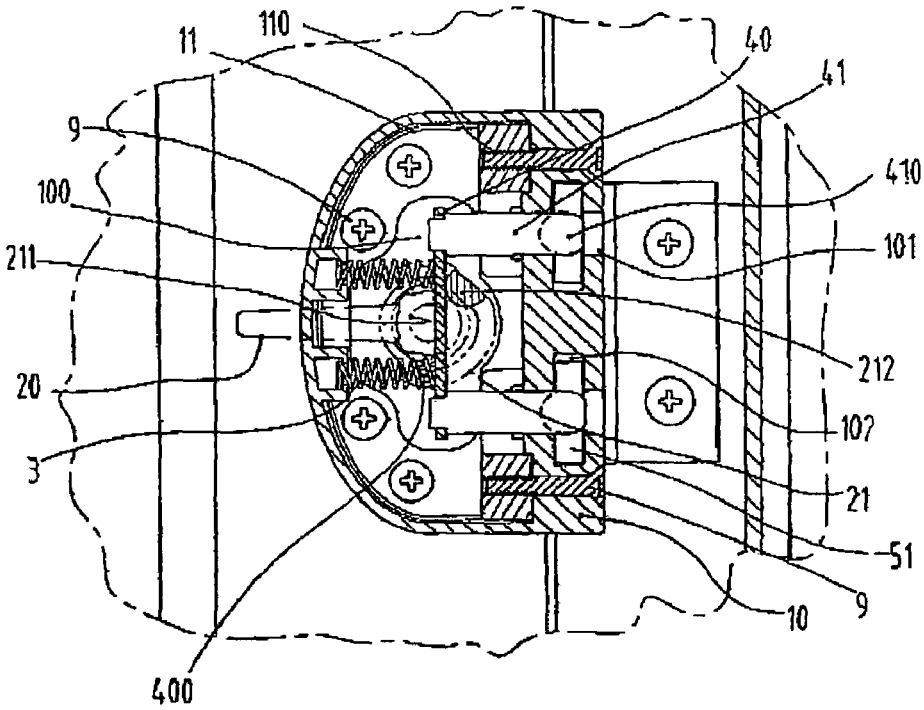
FIG. SEVEN
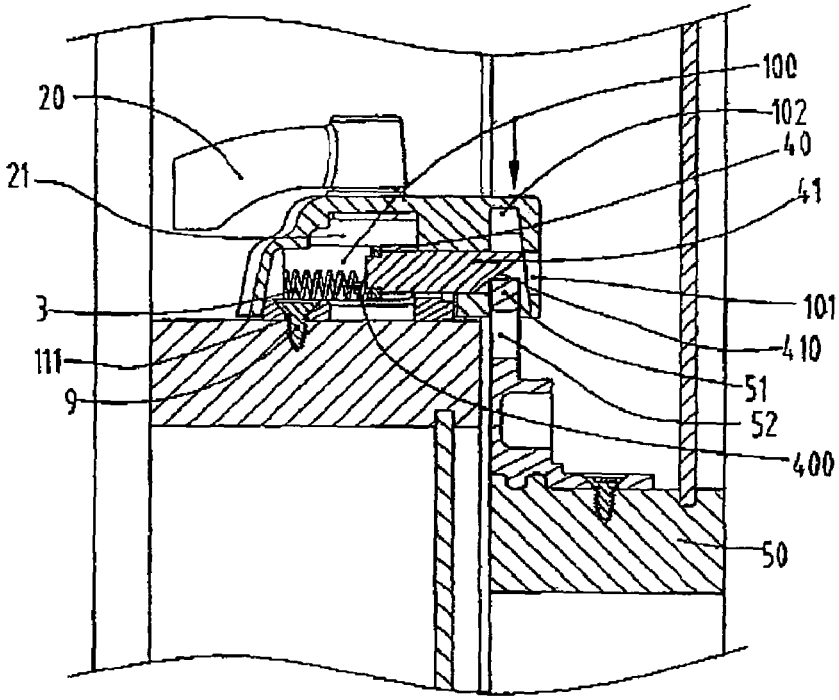
FIG. THREE

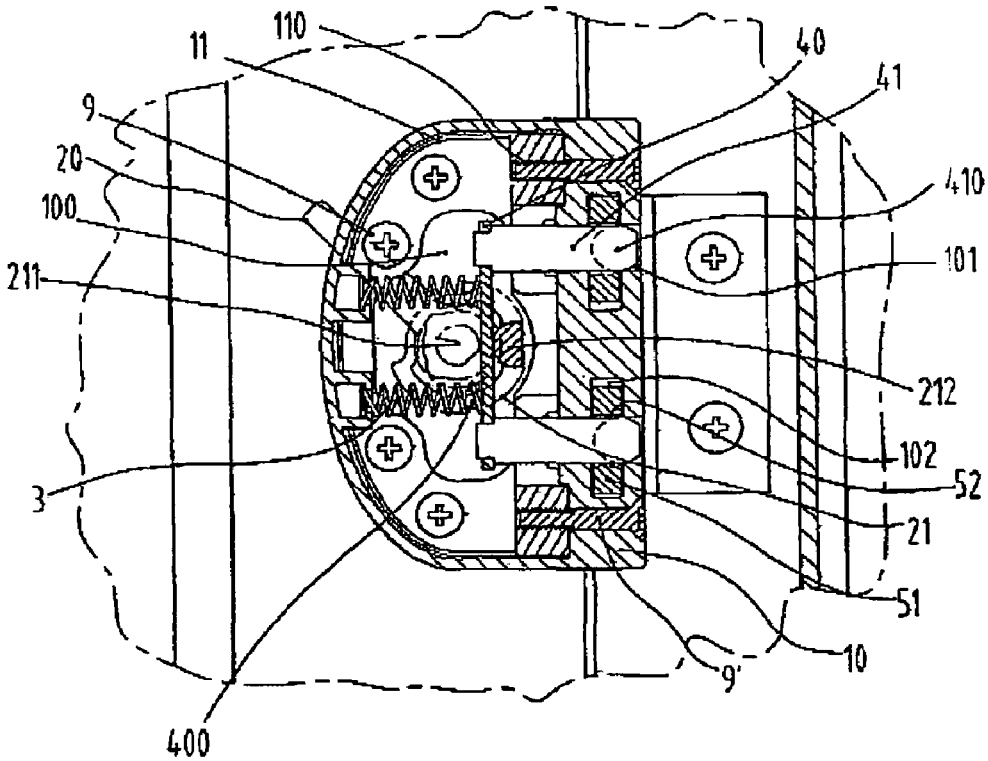
FIG. EIGHT
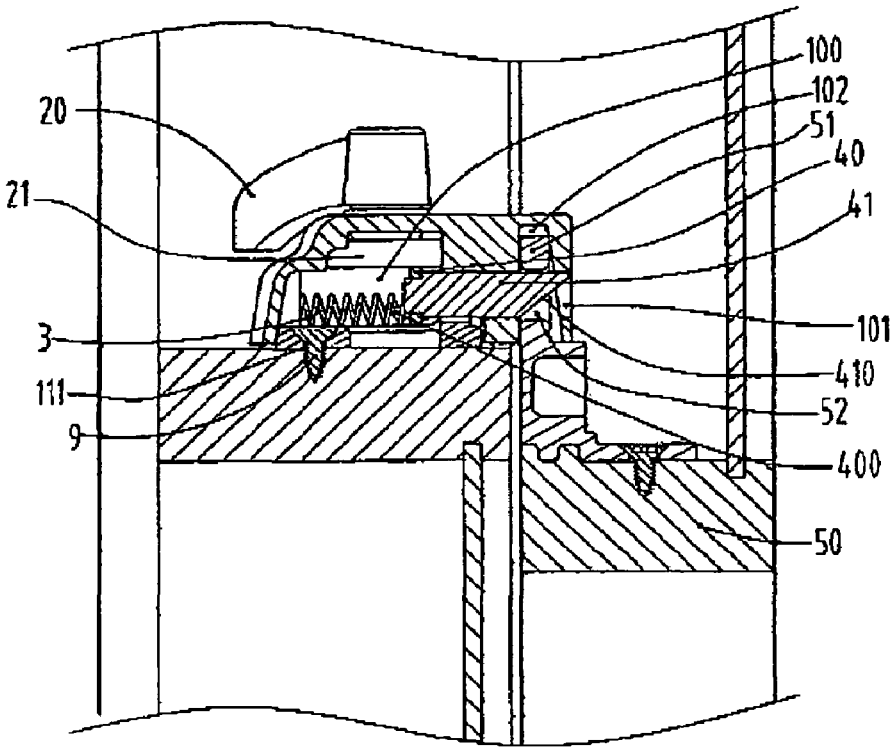
FIG. FOUR

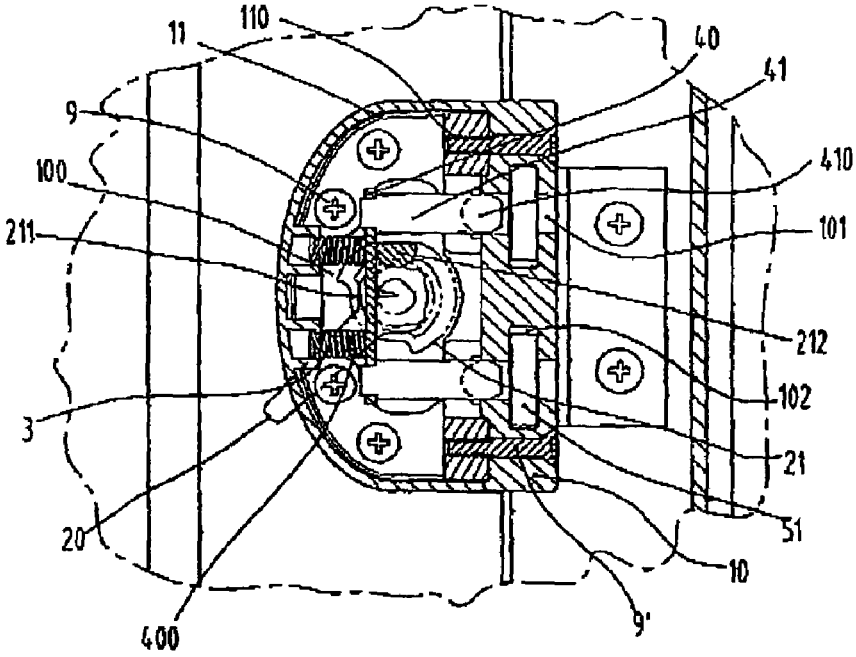
FIG. NINE
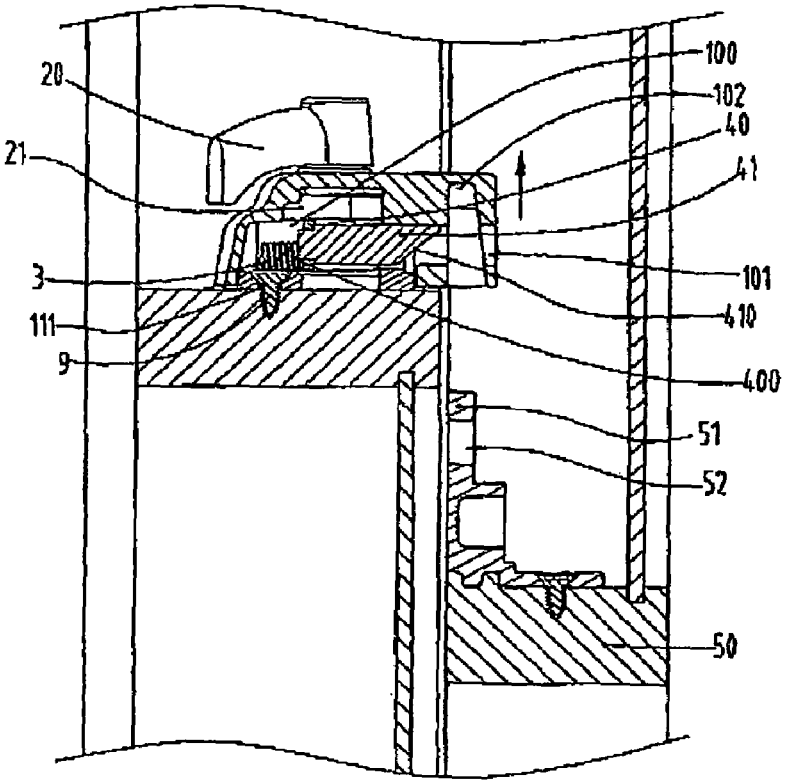
FIG. FIVE

LATCH DEVICE FOR SLIDING WINDOWS

CROSS-REFERENCE TO RELATED APPLICATIONS

This is a continuation application of application Ser. No. 10/463,971, filed Jun. 17, 2003, now abandoned which is incorporated herein by reference in its entirety.

FIELD OF THE INVENTION

The present invention relates to a latch device for sliding windows and includes a handle which rotates a driving member to control the movement of the latch member.

BACKGROUND OF THE INVENTION

A conventional sliding window generally includes a sliding window and a fixed window. The sliding window includes a locking device which is engaged with a cooperated device on the fixed window. The user has to completely pull the sliding window down to a close position and then the user has to operate the locking device to lock the window. The user could forget to lock the window after the sliding window is completely pulled down and this could result in a dangerous break-in crime.

The present invention intends to provide a latch device that automatically locks the windows after the sliding window is completely pulled down. The latch device includes a handle for rotating a driving member which has an eccentric mechanism for moving the latch member to be engaged with a cooperated frame on a fixed part of the window.

SUMMARY OF THE INVENTION

In accordance with one aspect of the present invention, there is provided a latch device for windows and the latch device comprises a casing fixed to a sliding window. The casing has a recess for receiving a latch member which is biased by a spring. A driving assembly is engaged with the latch member which retractably retracted through a front wall of the casing by operating the driving assembly.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is an exploded view to show the latch device of the present invention;

FIG. 2 is a side cross sectional view to show the sliding window is to be moved downward;

FIG. 3 shows the inclined surfaces on the latches are pushed by the latching plate on the fixed window;

FIG. 4 shows the latches are engaged with engaging holes in the latching plate on the fixed window;

FIG. 5 is a side cross sectional view to show the handle is rotated to retract the latches before opening the window;

FIG. 6 is a top cross sectional view to show the latch device as shown in FIG. 2;

FIG. 7 is a top cross sectional view to show the latch device as shown in FIG. 3;

FIG. 8 is a top cross sectional view to show the latch device as shown in FIG. 4, and FIG. 9 is a top cross sectional view to show the latch device as shown in FIG. 5.

DETAILED DESCRIPTION OF THE PREFERRED EMBODIMENT

Referring to FIGS. 1, 2 and 6, the latch device for sliding windows of the present invention comprises a casing 1 and a body 11 which is fixed to the sliding window 5 by bolts 9 extending through holes 111 in the body 11 and fixed to the sliding window 5. The casing 1 has an open bottom and a top, and is fixedly mounted to the body 11 by bolts 9' extending through holes 104 in a front wall of the casing 10 and threadedly engaged with the treaded holes 110 in the body 11. A recess 100 is defined in the open bottom of the casing 1 and a receiving slot 102 is defined in an underside of the casing 1. Holes 101 are defined through a front wall and an inside of the receiving slot 102, and are in communication with the recess 100.

A latch member 4 is movably received in the recess 100 and biased by two springs 3. The latch member 4 includes a plate 40 and two latches 41 extend from the plate 40. Each of the latches 41 has an inclined surface 410 defined in a distal end thereof. The latch member 4 further has two bosses 400 for being engaged with the springs 3.

A driving assembly 2 includes a driving member 21 received in the recess 100 of the casing 1 and a handle 20 which has a polygonal shaft 201 so as to be engaged with a polygonal hole 211 defined in the driving member 21. The handle 20 is located on an outside of the casing 1 and can be swung by a user to rotate the driving member 21. An eccentric protrusion 212 extends from the driving member 21 and contacts a front surface of the plate 40 of the latch member 41.

Referring to FIGS. 2 and 6, when the handle 20 is located at a close position and the latches 41 are extended transversely through the receiving slot 102. As shown in FIGS. 3 and 7, when the sliding window 5 is pulling downward, the latching plate 51 on the fixed window 50 is inserted into the receiving slot 102 and the inclined surfaces 410 on the latches 41 are pushed by the top of the latching plate 51 so that the latch member 4 is moved to the left till the two latches 41 are pushed by the springs 3 into the engaging holes 52 in the latching plate 51 as shown in FIGS. 4 and 8. In other words, the user needs not to operate the handle 20 and the sliding window 5 is automatically locked.

When the user wants to open the sliding window 5, he or she pivots the handle 20 as shown in FIGS. 5 and 9, the driving member 21 pushes the latch member 4 to compress the springs 3 by the protrusion 212 so that the latches 41 are retracted and disengaged from the engaging holes 52 in the latching plate 51 of the fixed window 50.

While we have shown and described the embodiment in accordance with the present invention, it should be clear to those skilled in the art that further embodiments may be made without departing from the scope of the present invention.

What is claimed is:

1. A latch device for windows, comprising:

a casing adapted to be fixed to a sliding window and having a recess defined in an underside thereof, the casing defining a front wall and at least one slot for receiving a latching plate, a latch member movably received in the recess and biased by a spring in a direction through the slot and at least partially into the front wall of the casing, a driving assembly having a driving member received in the recess of the casing and an eccentric protrusion extending from the driving member and movably engaged with the latch member, the driving member having a non-round hole defined therethrough, and a handle having a non-round shaft which is engaged with the non-round hole in the driving member, the latch member being retracted through the front wall of the casing by operating the handle, the latch member including two latches and each latch defining an inclined surface configured to engage the latching plate disposed in the slot of the casing.

2. The latch device as claimed in claim 1 further comprising a body which is adapted to be fixed to sliding window, the casing fixedly mounted to the body.

3. A latch device for locking a sliding window to a latching plate, the latch device comprising:

a casing adapted to be fixed to the sliding window, the casing having a recess defined in an underside thereof, and the casing defining a front wall and at least one slot for receiving the latching plate, the slot being defined between the front wall and the recess;

first and second latches movably received in the recess and biased by a spring in a direction through the slot and at least partially into to front wall of the casing;

a driving assembly having a driving member received in the recess of the casing and an eccentric protrusion extending from the driving member and movably engaged with the latches; and a handle having a shaft engaged with the driving member, such that the handle is configured to be rotated to operate the driving assembly and thereby retract the latches from the front wall of the casing and into the recess, wherein the front wall of the casing defines an angled inner surface such that the slot is tapered and the front wall is configured to adjust the latch plate toward the recess as the latch plate is received into the slot, and wherein each latch defines an inclined surface configured to engage the latching plate disposed in the slot such that the latches are configured to be retracted into the recess as the latch plate is received into the slot.

4. The latch device as claimed in claim 3 wherein the inclined surface of each latch is disposed at an angle relative to a longitudinal direction of each latch along which the latches are moved through the slot such that each inclined surface is configured to contact the latch plate when the latch plate is received in the slot.

5. The latch device as claimed in claim 4 wherein the inclined surface of each latch is a flat surface.

6. The latch device as claimed in claim 5 wherein each latch has a cylindrical outer surface extending to the inclined surface.

7. The latch device as claimed in claim 3 wherein the latches are enclosed by the casing such that an outer surface of each latch disposed in the slot is not accessible when the latch plate is received in the slot.

8. The latch device as claimed in claim 3 wherein the front wall defines first and second holes corresponding to the latches, each hole being configured to receive a respective one of the latches such that the latches are supported by the front wall.

9. The latch device as claimed in claim 3 wherein the driving member defines a non-round hole and the handle defines a corresponding non-round shaft that is engaged with the non-round hole in the driving member.

10. The latch device as claimed in claim 3 wherein the casing defines two of the slots, each slot being configured to receive a respective portion of the latching plate and a respective one of the latches.

11. The latch device as claimed in claim 10 wherein the inclined surface of each latch is disposed at an angle relative to a longitudinal direction of each latch along which the latches are moved through the slots such that each inclined surface is configured to contact the respective portion of the latching plate when the latching plate is received in the slots.

12. The latch device as claimed in claim 11 wherein the inclined surface of each latch is a flat surface.

13. The latch device as claimed in claim 12 wherein each latch has a cylindrical outer surface extending to the inclined surface.

14. The latch device as claimed in claim 11 wherein the latches are enclosed by the casing such that an outer surface of each latch disposed in the slot is not accessible when the latch plate is received in the slot.

15. The latch device as claimed in claim 14 wherein the front wall defines first and second holes corresponding to the latches, each hole being configured to receive a respective one of the latches such that the latches are supported by the front wall.

16. The latch device as claimed in claim 10 wherein the driving member defines a non-round hole and the handle defines a corresponding non-round shaft that is engaged with the non-round hole in the driving member.

* * * * *

UNITED STATES PATENT AND TRADEMARK OFFICE

CERTIFICATE OF CORRECTION

PATENT NO. : 7,097,214 B2
APPLICATION NO. : 11/231524
DATED : August 29, 2006
INVENTOR(S) : Tsai It is certified that error appears in the above-identified patent and that said Letters Patent is hereby corrected as shown below:

Column 3,
Line 14, after "fixed to" insert --the--;
Line 25, "to" should read --the--.

Signed and Sealed this

Ninth Day of January, 2007

JON W. DUDAS
*Director of the United States Patent and Trademark Office*